US008082985B2

(12) United States Patent
Clark et al.

(10) Patent No.: US 8,082,985 B2
(45) **Date of Patent: *Dec. 27, 2011**

(54) LOCKABLE ANCHOR FOR INSERTABLE PROGRESSING CAVITY PUMP

(75) Inventors: Craig Willis Clark, Sherwood Park (CA); Todd A. Wilson, Lloydminster (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/023,714

(22) Filed: Feb. 9, 2011

(65) Prior Publication Data

US 2011/0127030 A1 Jun. 2, 2011

Related U.S. Application Data

(62) Division of application No. 11/828,887, filed on Jul. 26, 2007, now Pat. No. 7,905,294.

(51) Int. Cl.
*E21B 23/01* (2006.01)

(52) U.S. Cl. ..... 166/212; 166/382

(58) Field of Classification Search ..... 166/382, 166/212, 213, 88.1, 106, 217
See application file for complete search history.

(56) References Cited

U.S. PATENT DOCUMENTS 2,062,058 A 11/1936 Howe
3,570,599 A 3/1971 Wilson et al.
6,318,459 B1 11/2001 Wright et al.
7,905,294 B2 3/2011 Clark et al.
2005/0168349 A1 8/2005 Huang et al.

FOREIGN PATENT DOCUMENTS

GB 2 357 533 6/2001
WO WO 97/35094 9/1997

OTHER PUBLICATIONS

GB Examination Report for Application No. GB0813642.6 dated Apr. 4, 2011.
Canadian Office Action for Application No. 2,638,260 dated May 30, 2011.
Caledyne PCP Sealing Anchor, Caledyne 2005, 1 Page.
Insert Pump Anchor, Weatherford Artificial Lift Systems, 2002, 2 Pages.
G-Pack, Nov. 14, 2005, 1 Page.
Canadian Office Action for Application No. 2,638,260 dated Oct. 8, 2009.
GB Search Report for Application No. GB0813642.6 dated Sep. 29, 2008.

*Primary Examiner* — David Andrews
(74) *Attorney, Agent, or Firm* — Patterson & Sheridan, L.L.P.

(57) ABSTRACT

Embodiments of the invention generally relate to methods and apparatuses for anchoring progressing cavity (PC) pumps. In one embodiment, a method of anchoring a PC pump to a string of tubulars disposed in a wellbore which includes acts of inserting the PC pump and anchor assembly into the tubular. Running the PC pump and anchor assembly through the tubular to any first longitudinal location along the tubular string. Longitudinally and rotationally coupling the PC pump and the anchor assembly to the tubular and forming a seal between the PC pump and the tubular string at the first location and performing a downhole operation in the tubular.

20 Claims, 10 Drawing Sheets

LOCKABLE ANCHOR FOR INSERTABLE PROGRESSING CAVITY PUMP

CROSS-REFERENCE TO RELATED APPLICATIONS

This application is a divisional of U.S. patent application Ser. No. 11/828,887 filed Jul. 26, 2007 now U.S. Pat. No. 7,905,294, which is herein incorporated by reference in its entirety.

BACKGROUND OF THE INVENTION

1. Field of the Invention

Embodiments described herein are directed toward artificial lift systems used to produce fluids from wellbores, such as crude oil and natural gas wells. More particularly, embodiments described herein are directed toward an improved anchor for use with a downhole pump. More particularly, the embodiments described herein are directed to a resettable anchor configured to prevent longitudinal and rotational movement of the pump relative to a tubular.

2. Description of the Related Art

Modern oil and gas wells are typically drilled with a rotary drill bit and a circulating drilling fluid or "mud" system. The mud system (a) removes drill bit cuttings from the wellbore during drilling, (b) lubricates and cools the rotating drill bit, and (c) provides pressure within the borehole to balance internal pressures of formations penetrated by the borehole. Rotary motion is imparted to the drill bit by rotation of a drill string to which the bit is attached. Alternately, the bit is rotated by a mud motor which is attached to the drill string just above the drill bit. The mud motor is powered by the circulating mud system. Subsequent to the drilling of a well, or alternately at intermediate periods during the drilling process, the borehole is cased typically with steel casing, and the annulus between the borehole and the outer surface of the casing is filled with cement. The casing preserves the integrity of the borehole by preventing collapse or cave-in. The cement annulus hydraulically isolates formation zones penetrated by the borehole that are at different internal formation pressures.

Numerous operations occur in the well borehole after casing is "set". All operations require the insertion of some type of instrumentation or hardware within the borehole. Examples of typical borehole operations include: (a) setting packers and plugs to isolate producing zones; (b) inserting tubing within the casing and extending the tubing to the prospective producing zone; and (c) inserting, operating and removing pumping systems from the borehole.

Fluids can be produced from oil and gas wells by utilizing internal pressure within a producing zone to lift the fluid through the well borehole to the surface of the Earth. If internal formation pressure is insufficient, artificial fluid lift devices and methods may be used to transfer fluids from the producing zone and through the borehole to the surface of the Earth.

One common artificial lift technology utilized in the domestic oil industry is the sucker rod pumping system. A sucker rod pumping system consists of a pumping unit that converts a rotary motion of a drive motor to a reciprocating motion of an artificial lift pump. A pump unit is connected to a polish rod and a sucker rod "string" which, in turn, operationally connects to a rod pump in the borehole. The string can consist of a group of connected, essentially rigid, steel sucker rod sections (commonly referred to as "joints") in lengths, such as twenty-five or thirty feet (ft), and in diameters, such as ranging from five-eighths inch (in.) to one and one-quarter in.

Joints are sequentially connected or disconnected as the string is inserted or removed from the borehole, respectively. Alternately, a continuous sucker rod (hereafter referred to as COROD) string can be used to operationally connect the pump unit at the surface of the Earth to the rod pump positioned within the borehole. A delivery mechanism rig (hereafter CORIG) is used to convey the COROD string into and out of the borehole.

Prior art borehole pump assemblies of sucker rod operated artificial lift systems typically utilize a progressing cavity (PC) pump positioned within wellbore tubing. FIG. 1A is a sectional view of a prior art PC pump 100. A pump housing 110 contains an elastomeric stator 130*a* having multiple lobes 125 formed in an inner surface thereof. The pump housing 110 is usually made from metal, preferably steel. The stator 130*a* has five lobes. Although, the stator 130*a* may have two or more lobes. Inside the stator 130*a* is a rotor 118. The rotor 118 having one lobe fewer than the stator 130*a* formed in an outer surface thereof. The inner surface of the stator 130*a* and the outer surface of the rotor 118 also twist along respective longitudinal axes, thereby each forming a substantially helical-hypocycloid shape. The rotor 118 is usually made from metal, preferably steel. The rotor 118 and stator 130*a* interengage at the helical lobes to form a plurality of sealing surfaces 160. Sealed chambers 147 between the rotor 118 and stator 130*a* are also formed. In operation, rotation of the sucker rod or COROD string causes the rotor 118 to nutate or precess within the stator 130*a* as a planetary gear would nutate within an internal ring gear, thereby pumping production fluid through the chambers 147. The centerline of the rotor 118 travels in a circular path around the centerline of the stator 120.

One drawback in such prior art motors is the stress and heat generated by the movement of the rotor 118 within the stator 130*a*. There are several mechanisms by which heat is generated. The first is the compression of the elastomeric stator 130*a* by the rotor 118, known as interference. Radial interference, such as five-thousandths of an inch to thirty-thousandths of an inch, is provided to seal the chambers to prevent leakage. The sliding or rubbing movement of the rotor 118 combined with the forces of interference generates friction. In addition, with each cycle of compression and release of the elastomeric stator 130*a*, heat is generated due to internal viscous friction among the elastomer molecules. This phenomenon is known as hysteresis. Cyclic deformation of the elastomer occurs due to three effects: interference, centrifugal force, and reactive forces from pumping. The centrifugal force results from the mass of the rotor moving in the nutational path previously described. Reactive forces from torque generation are similar to those found in gears that are transmitting torque. Additional heat input may also be present from the high temperatures downhole.

Because elastomers are poor conductors of heat, the heat from these various sources builds up in the thick sections 135*a-e* of the stator lobes. In these areas the temperature rises higher than the temperature of the circulating fluid or the formation. This increased temperature causes rapid degradation of the elastomeric stator 130*a*. Also, the elevated temperature changes the mechanical properties of the elastomeric stator 130*a*, weakening each of the stator lobes as a structural member and leading to cracking and tearing of sections 135*a-e*, as well as portions 145*a-e* of the elastomer at the lobe crests. This design can also produce uneven rubber strain between the major and minor diameters of the pumping section. The flexing of the lobes 125 also limits the pressure capability of each stage of the pumping section by allowing more fluid slippage from one stage to the subsequent stages below.

Advances in manufacturing techniques have led to the introduction of even wall PC pumps 150 as shown in FIG. 1B. A thin tubular elastomer layer 170 is bonded to an inner surface of the stator 130*b* or an outer surface of the rotor 118 (layer 170 bonded on stator 130*b* as shown). The stator 130*b* is typically made from metal, preferably steel. These pumps 150 provide more power output than the traditional designs above due to the more rigid structure and the ability to transfer heat away from the elastomer 170 to the stator 130*b*. With improved heat transfer and a more rigid structure, the new even wall designs operate more efficiently and can tolerate higher environmental extremes. Although the outer surface of the stator 130*b* is shown as round, the outer surface may also resemble the inner surface of the stator. Further, the rotor 118 may be hollow.

FIG. 2 illustrates a prior art insertable PC pump assembly 200. The PC pump assembly 200 includes a rotor sub-assembly, a stator sub-assembly, and a special production tubing sub-assembly. The special production tubing sub-assembly is assembled and run-in with the production tubing. The production tubing sub-assembly includes a pump seating nipple 236, a collar 238, and a locking tubing joint 240. The pump seating nipple 236 is connected to the collar 238 by a threaded connection. The nipple 236 includes a profile formed on an inner surface thereof for seating a profile formed on an outer surface of a seating mandrel 220. The collar 238 is connected to the locking tubing 240 by a threaded connection. The locking tubing joint 240 includes a pin 242 protruding into the interior thereof. The pin 242 will receive a fork 234 of a tag bar 232, thereby forming a rotational connection. Before the PC pump assembly 200 is positioned and operated down hole, the special production tubing sub-assembly is installed as part of the production tubing string so that the pump will be positioned to lift from a particular producing zone of interest. If the PC pump assembly 200 is subsequently positioned at a shallower or at a deeper zone of interest within the well, this can be accomplished by removing the tubing string, or by adding or subtracting joints of tubing. This repositions the special joint of tubing as required.

The rotor sub-assembly includes a pony rod 212, a rod coupling 216, and a rotor 218. The top of the pony rod 212 is connected to a CORD string (not shown) or to a conventional sucker rod string (not shown) by the connector 214, thereby forming a threaded connection. The pony rod 212 is connected to the top of the rotor 218 by the rod coupling 216, thereby forming a threaded connection. The rotor 218 may resemble the rotor 118. An outer surface of the rod coupling 216 is configured to abut an inner surface of the cloverleaf insert 222, thereby longitudinally coupling the cloverleaf insert 222 and the rod coupling 216 in one direction. The rotor 218 is connected to the rod coupling 216 with a threaded connection.

The stator sub-assembly includes a seating mandrel 220, a cloverleaf insert 222, upper and lower flush tubes 224,226, a barrel connector 228, a stator 230, and the tag bar 232. The seating mandrel 220 is coupled to the upper flush tube 224 by a threaded connection and includes the profile formed on the outer surface thereof for seating in the nipple 236. The profile is formed by disposing elastomer sealing rings around the seating mandrel 220. The cloverleaf insert 222 is disposed in a bore defined by the seating mandrel 220 and the upper flush tube 224 and longitudinally held in place between a shoulder formed in each of the seating mandrel 220 and the upper flush tube 224. The inner surface of the cloverleaf insert 222 is configured to shoulder against the outer surface of the rod coupling 216. The lower flush tube 226 is coupled to the upper flush tube 224 by a threaded connection. Alternatively, the flush tube 224,226 may be formed as one integral piece. The barrel connector 228 is coupled to the lower flush tube 226 by a threaded connection. The stator 230 is coupled to the barrel connector 228 by a threaded connection. The stator 230 may be either the conventional stator 130*a* or the recently developed even-walled stator 130*b*. The tag bar 232 is connected to the stator 230 with a threaded connection. A fork 234 is formed at a longitudinal end of the tag bar 232 for mating with the pin 242, thereby forming a rotational connection between the tag bar 232 and the locking tubing 240. The tag bar 232 further includes a tag bar pin 235 (see FIG. 3) for seating a longitudinal end of the rotor 218.

FIG. 3A illustrates the rotor and stator sub-assemblies of the prior art PC pump assembly 200 being inserted into a borehole. The production tubing sub-assembly is installed as part of the production tubing string so that the PC pump assembly 200, when installed downhole, will be positioned to lift from a particular producing zone of interest. Once the production tubing sub-assembly is installed down hole as part of the tubing string, the rotor and stator sub-assemblies are assembled and run down hole inside of the production tubing using a CORD or conventional sucker rod system.

FIG. 3B illustrates the rotor and stator sub-assemblies being seated within the borehole. When reaching the special locking joint 240, the forked slot 234 at the lower end of the assembly tag bar 232 aligns with the pin 242 as shown in FIG. 3B. Once the fork slot 234 aligns with and engages the pin 242, the stator sub-assembly is locked radially within the locking joint 240 and can not rotate within the locking joint 240 when the PC pump assembly 200 is operated. After the fork 234 and pin 242 have aligned and engaged, the seating mandrel 220 will then slide into, seat with, and form a seal with the seating nipple 236. The prior art insertable PC pump assembly 200 is now completely installed down hole.

FIG. 3C illustrates the prior art PC pump assembly 200 in operation, where the rotor 218 is moved up and down within the stator 230 by the action of the pony rod 212 and connected sucker rod string (not shown). After compensating for sucker rod stretch, the sucker rod string is slowly lifted a distance 252, off of the tag bar pin 235 of the tag bar 232. This positions the rotor 218 in a proper operating position with respect to the stator 230.

FIG. 3D shows the system configured for flushing. During operation, it is possible that the insertable PC pump assembly 200 may need to be flushed to remove sand and other debris from the stator 230 and the rotor 218. To perform this flushing operation, the rotor 218 is pulled upward from the stator by the sucker rod string by a distance 254. In order to avoid disengaging the entire pump assembly 200 from the seating nipple 236, the rotor 218 is moved upward only until it is located in the flush tubes 224, 226. The PC pump assembly 200 may now be flushed, and then the rotor 218 reinstalled without completely reseating the entire PC pump assembly 200. Since the prior art insertable PC pump assembly 200 is picked up from the top of the rotor 218, the flush tubes 224, 226 are required. Furthermore, the length of the flush tubes 224, 226 must be at least as long as the rotor 218. The entire PC pump assembly 200 will then be at least twice as long as the stator 230. This presents a problem in optimizing stator length within the operation and clearly illustrates a major deficiency in prior art insertable PC pump systems.

FIG. 3E illustrates the rotor and stator sub-assemblies being removed from the locking joint 240 and seating nipple 236. The sucker rod string is lifted until the rod coupling 216 on the top of the rotor 218 engages with the cloverleaf insert 222. The seating mandrel 220 is then extracted from the seating nipple 236 by further upward movement of the sucker rod string, and the rotor and stator subassemblies are conveyed to the surface as the sucker rod string is withdrawn from the borehole.

The operating envelope of an insertable PC pump is dependent upon pump length, pump outside diameter, and the rotational operating speed. In the prior art PC pump assembly 200, the pump length is essentially fixed by the distance between the seating nipple 236 and the pin 242 of the locking joint 240. Pump diameter is essentially fixed by the seating nipple size. Stated another way, these factors define the operating envelope of the pump. For a given operating speed, production volume can be gained by lengthening stator pitch and decreasing the total number of pitches inside the fixed operating envelope. Volume is gained at the expense of decreasing lift capacity. On the other hand, lift capacity can be gained within the fixed operating envelope by shortening stator pitch and increasing the total number of pitches. Production volume can only be gained, at a given lift capacity, by increasing operating speed. This in turn increases pump wear and decreases pump life. For a given operating speed and a given seating nipple size, the operating envelope of the prior art system can only be changed by pulling the entire tubing string and adjusting the operating envelope by changing the distance between the seating nipple 236 and the pin 242. Alternately, the tubing can be pulled and the seating nipple 236 can be changed thereby allowing the operating envelope to be changed by varying pump diameter. Either approach requires that the production tubing string be pulled at significant monetary and operating expense.

In summary, the prior art insertable PC pump system described above requires a special joint of tubing containing a welded, inwardly protruding pin for radial locking and a seating nipple. The seating nipple places some restrictions upon the inside diameter of the tubing in which the pump assembly can be operated. This directly constrains the outside diameter of the insertable pump assembly. The overall distance between the pin and the seating nipple constrains the length of the pump assembly. In order to change the length of the pump assembly to increase lift capacity (by adding stator pitches) or to change production volume (by lengthening stator pitches), (1) the entire tubing string must be removed and (2) the distance between the seating nipple 236 and the locking pin 242 must be adjusted accordingly before the production tubing is reinserted into the well. Longitudinal repositioning of the PC pump assembly 200 without changing length can be done by adding or subtracting tubing joints to reposition the seating nipple 236 and the locking pin 242 as a unit. The prior art PC pump assembly 200 requires a flush tube 224,226 so that the rotor 218 can be removed from the stator 230 for flushing. This increases the length of the assembly and also adds to the mechanical complexity and the manufacturing cost of the assembly.

Therefore, there exists a need in the art for an insertable PC pump that does not require specialized components to be assembled with a production string.

SUMMARY OF THE INVENTION

Embodiments described herein generally relate to a method of anchoring a PC pump in a tubular located in a wellbore. The method comprises running the PC pump coupled to an anchor assembly to a first longitudinal location inside the tubular and actuating the anchor assembly thereby engaging the tubular with an anchor of the anchor assembly. The engaging of the tubular thereby preventing the rotation and longitudinal movement of the anchor assembly relative to the tubular. The method further comprises setting off a relief valve in the anchor assembly thereby releasing the anchor assembly from the tubular.

Embodiments described herein further relate to an anchoring assembly for anchoring a downhole tool in a tubular in a wellbore. The anchoring assembly comprises an inner mandrel, and an anchor actuatable by the manipulation of the inner mandrel. The anchoring assembly further comprises an engagement member configured to engage an inner wall of the tubular and resist longitudinal forces applied to the anchoring assembly. The anchoring assembly further comprises an actuation assembly having one or more one way valves configured to allow fluid to flow from a first piston chamber to a second piston chamber and a relief valve configured to release fluid pressure in the second piston chamber, wherein the relief valve allows the release of the anchor when a predetermined fluid pressure is applied to the second piston chamber.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 5A illustrates the PC pump system being run-into a wellbore. FIG. 5B illustrates the PC pump system in a preset position. FIG. 5C illustrates the PC pump system in a set position. FIG. 5D illustrates the PC pump system in a pre-operational position. FIG. 5E illustrates the PC pump system in an operational position. FIG. 5F illustrates the improved PC pump system in a flushing position. FIG. 5G illustrates the improved PC pump system being removed from the borehole.

DETAILED DESCRIPTION

Figure 1B:
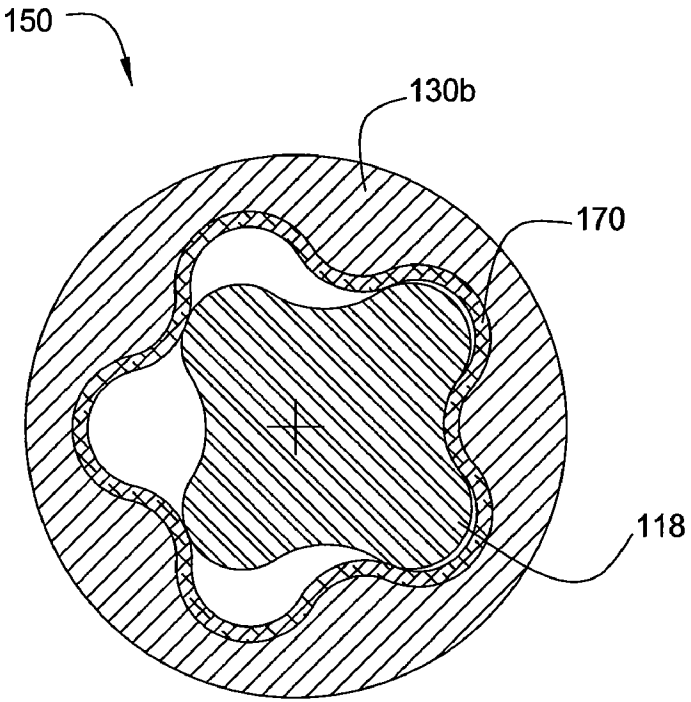
FIG. 1B (PRIOR ART)
FIG. 1B is a sectional view of a prior art even wall PC pump.
Figure 1A:
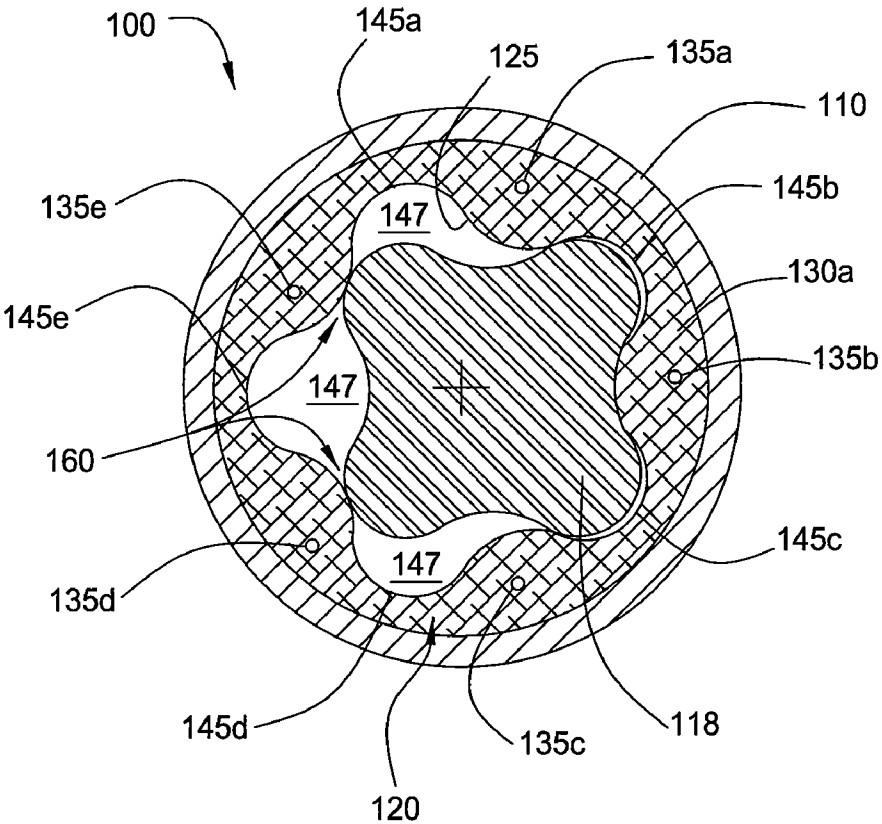
FIG. 1A (PRIOR ART)
FIG. 1A is a sectional view of a prior art progressing cavity (PC) pump.
Figure 2:
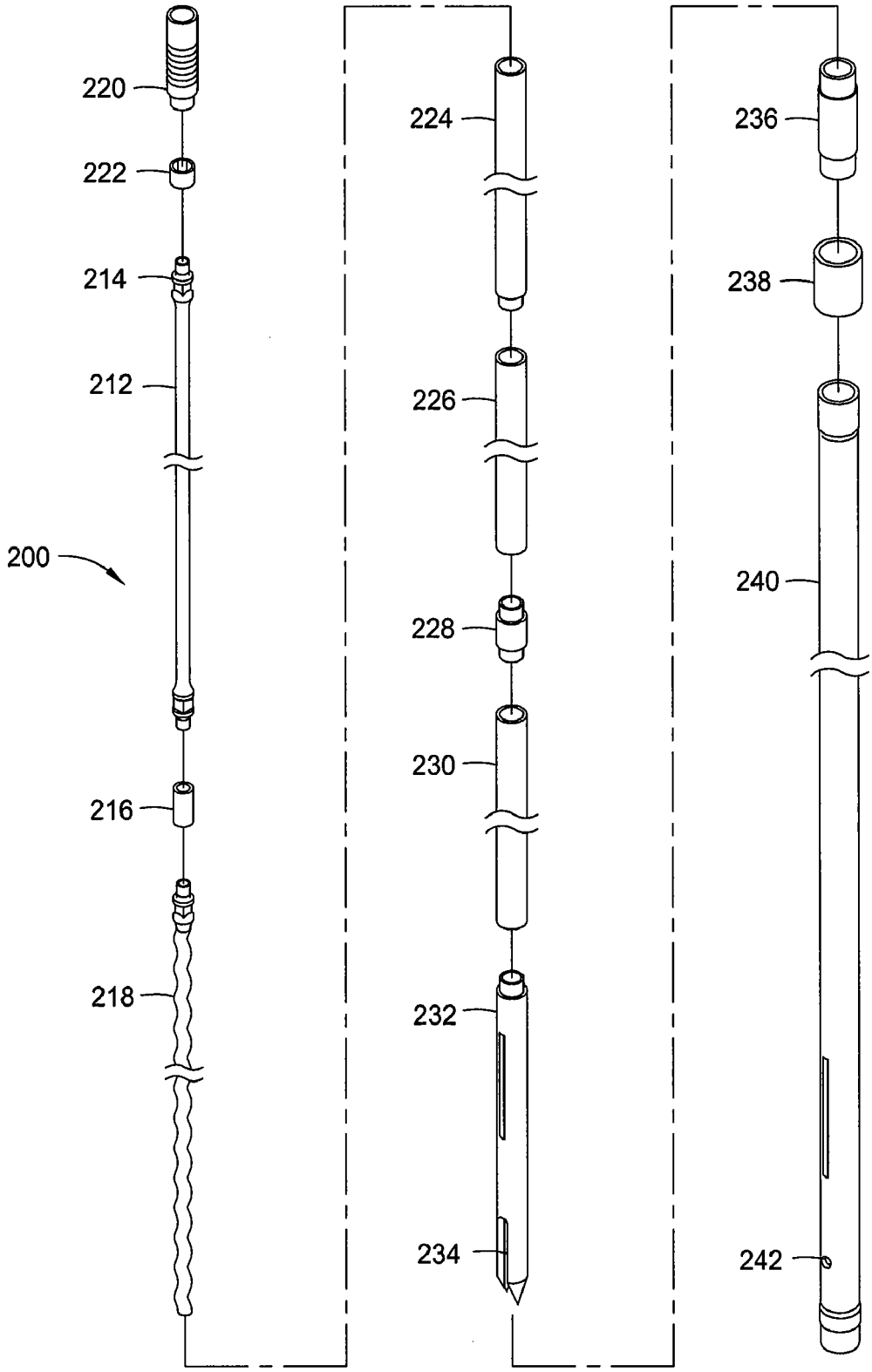
FIG. 2 (PRIOR ART)
FIG. 2 illustrates a prior art insertable PC pump system.
Figure 3A:
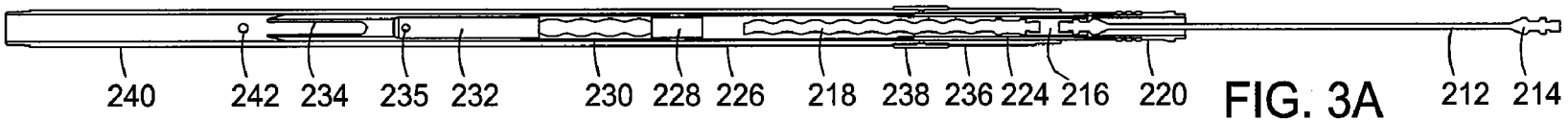
FIG. 3A (PRIOR ART)
FIG. 3A illustrates rotor and stator sub-assemblies of a prior art PC pump system being inserted into a borehole.
Figure 3B:
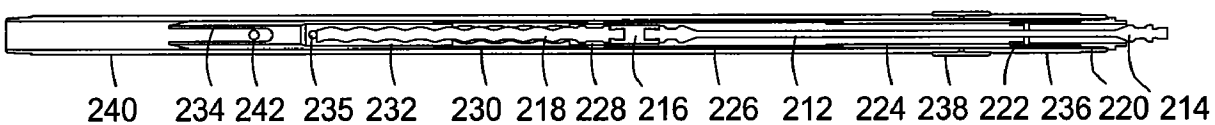
FIG. 3B (PRIOR ART)
FIG. 3B illustrates the rotor and stator sub-assemblies being seated within the borehole.
Figure 3C:
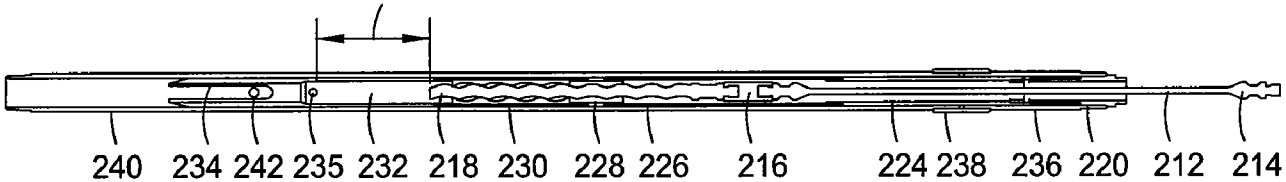
FIG. 3C (PRIOR ART)
FIG. 3C illustrates the prior art PC pump system being operated within the borehole.
Figure 3D:
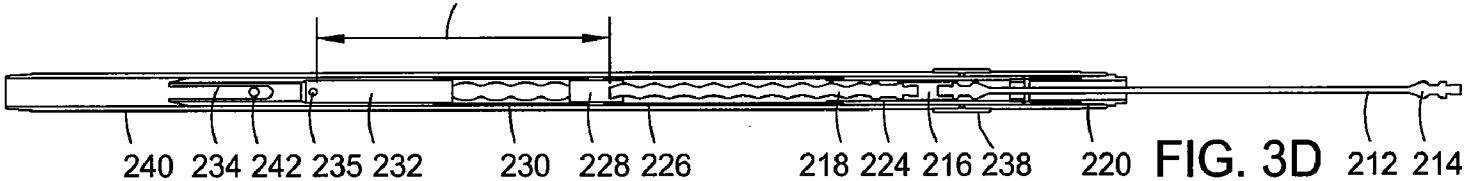
FIG. 3D (PRIOR ART)
FIG. 3D illustrates the prior art PC pump system being flushed.
Figure 3E:
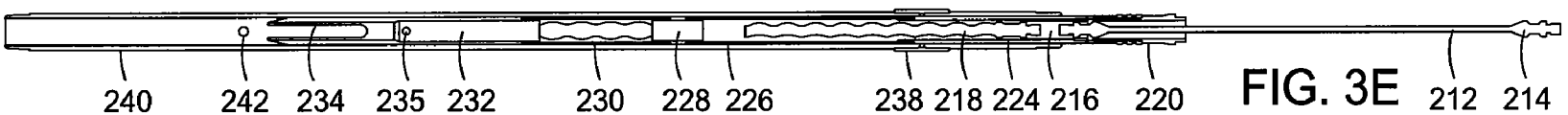
FIG. 3E (PRIOR ART)
FIG. 3E illustrates the rotor and stator sub-assemblies being removed from the borehole.
Figure 4A:
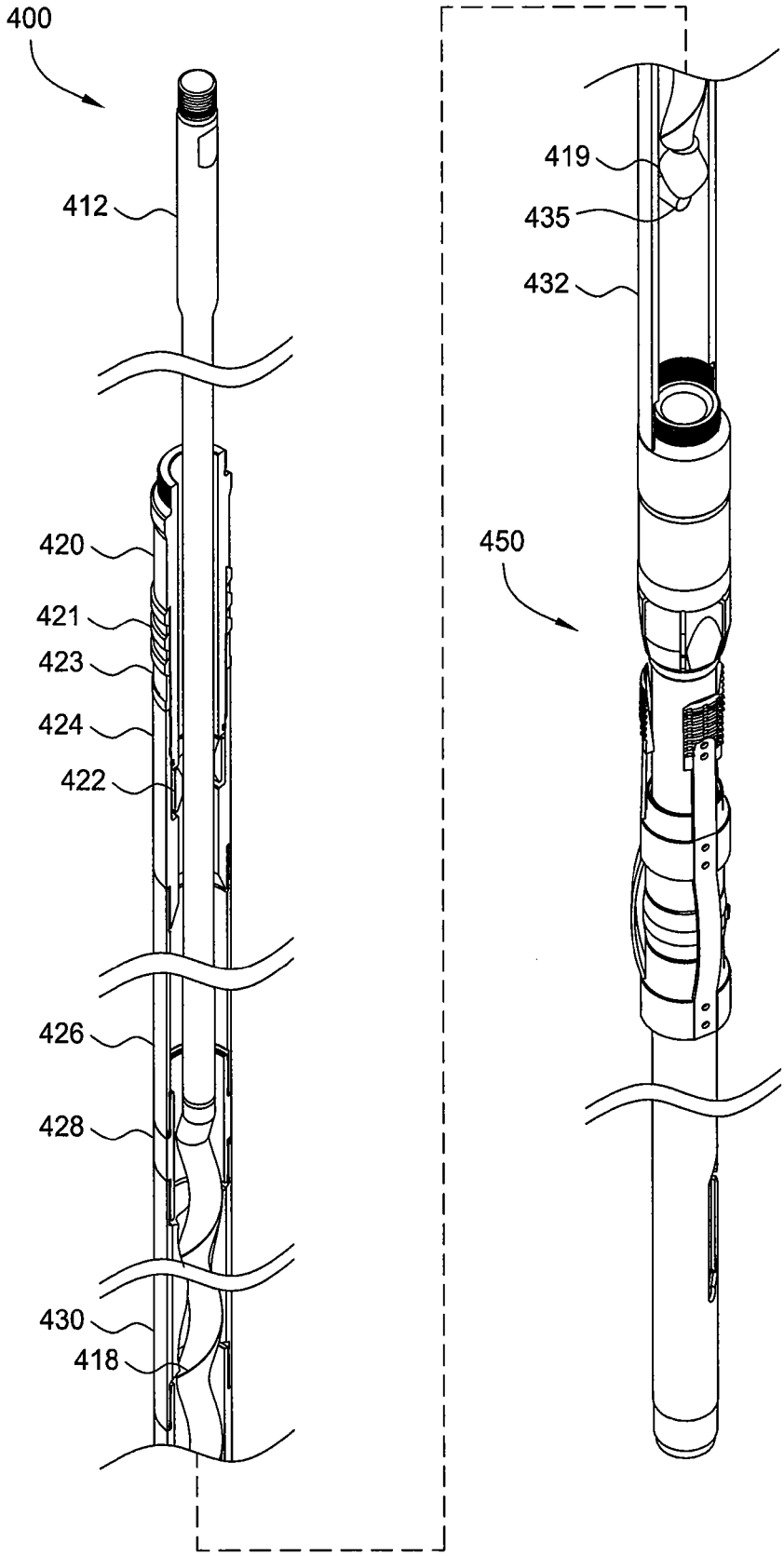
FIG. 4A is an isometric sectional view of a PC pump assembly, according to one embodiment of the present invention.

FIG. 4A is an isometric sectional view of a PC pump assembly 400, according to one embodiment of the present invention. Unlike the prior art PC pump assembly 200, the PC pump assembly 400 does not require a special production tubing sub-assembly. In other words, the PC pump assembly 400 is capable of longitudinal and rotational coupling to an inner surface of a conventional production tubing string at any longitudinal location along the production tubing string. This feature allows for installation of the PC pump assembly 400 at a first longitudinal location or depth along the production tubing string, operation of the PC pump assembly 400, and relocation of the PC pump assembly to a second longitudinal location or depth along the production tubing string, which may be closer or farther from the surface relative to the first location, without pulling and reconfiguration of the production tubing string. The PC pump assembly 400 includes a rotor subassembly, a stator subassembly, and an anchor subassembly 450. Unless otherwise specified, components of the PC pump assembly 400 are made from metal, such as steel or stainless steel.

The rotor subassembly includes a pony rod 412, a rotor 418, and a wedge-shaped structure or arrowhead 419. The pony rod 412 includes a threaded connector at a first longitudinal end for connection with a drive string, such as a conventional sucker rod string, a CORED string, a wireline, a coiled tubing string, or a string of jointed (i.e., threaded joints) tubulars. A wireline may be used for instances where the PC pump assembly 400 is driven by an electric submersible pump (ESP). The coiled tubing string may be used for instances where the PC pump is driven by a downhole hydraulic motor. The pony rod 412 may connect at a second longitudinal end to a first longitudinal end of the rotor 418 by a threaded connection. The rotor 418 may resemble the rotor 118. The arrowhead 419 may connect to a second longitudinal end of the rotor by a threaded connection. The wedge-shaped outer surface of the arrowhead 419 facilitates insertion and removal of the rotor 418 through the stator 430. The outer surface of the arrowhead 419 is also configured to interfere with an inner surface of the floating ring 422 to provide longitudinal coupling therebetween in one direction. Alternatively, any type of no-go device, such as one similar to the rod coupling 216, may be used instead of the arrowhead 419.

The stator subassembly includes an optional seating mandrel 420, a floating ring 422, an optional ring housing 424, a flush tube 426, a barrel connector 428, a stator 430, and a tag bar 432. The seating mandrel 420, the floating ring 422, the ring housing 424, the flush tube 426, the barrel connector 428, and the tag bar 432 are tubular members each having a central longitudinal bore therethrough. The seating mandrel 420 is coupled to the upper flush tube 426 by a threaded connection and includes an optional profile formed on the outer surface thereof for seating in the nipple 236. The profile may be provided in cases where the nipple 236 has already been installed in the production tubing. The profile is formed by disposing one or more sealing rings 421 around the seating mandrel 420. The sealing rings 421 are longitudinally coupled to the seating mandrel 420 at a first end by a shoulder formed in an outer surface of the seating mandrel 420 and at a second end by abutment with a first longitudinal end of a gage ring 423. The gage ring 423 has a threaded inner surface and is disposed on a threaded end of the seating mandrel 420.

The ring housing 424 has a threaded inner surface at a first longitudinal end and is disposed on the threaded end of the seating mandrel 420. The first longitudinal end of the ring housing 424 abuts a second longitudinal end of the gage ring 423 and is connected to the threaded end of the seating mandrel 420 with a threaded connection. The threaded end of the seating mandrel 420 has an o-ring and a back-up ring disposed therein (in an unthreaded portion). An inner surface of the ring housing 424 forms a shoulder and the floating ring 422 is disposed, with some clearance, between the shoulder of the ring housing 424 and the threaded end of the seating mandrel 420, thereby allowing limited longitudinal movement of the floating ring 422. Clearance is also provided between an outer surface of the floating ring 422 and the inner surface of the ring housing 424, thereby allowing limited radial movement of the floating ring 422. The inner surface of the floating ring 422 is configured to interfere with the outer surface of the arrowhead 419, thereby providing longitudinal coupling therebetween in one direction. Preferably, this configuration is accomplished by ensuring that a minimum inner diameter of the floating ring 422 is less than a maximum outer diameter of the arrowhead 419. The floating action of the floating ring 422, provided by the longitudinal and radial clearances, allows the rotor 418 to travel therethrough. Alternatively, any no-go ring, such as the cloverleaf insert 222, may be used instead of the floating ring 422.

The flush tube 426 is coupled to the ring housing 424 by a threaded connection. Alternatively, the flush tube 426 and the ring housing 424 may be formed as one integral piece. The barrel connector 428 is coupled to the flush tube 426 by a threaded connection. The stator 430 is coupled to the barrel connector 428 by a threaded connection. The stator 430 may be either the conventional stator 130*a* or the recently developed even-walled stator 130*b*. The tag bar 432 is connected to the stator 430 with a threaded connection. The tag bar 432 includes a tag bar pin 435 for seating the arrowhead 419. A cap 452 (see FIG. 4B) of the anchor subassembly 450 is connected to the tag bar 432 with a threaded connection.

Figure 4B:
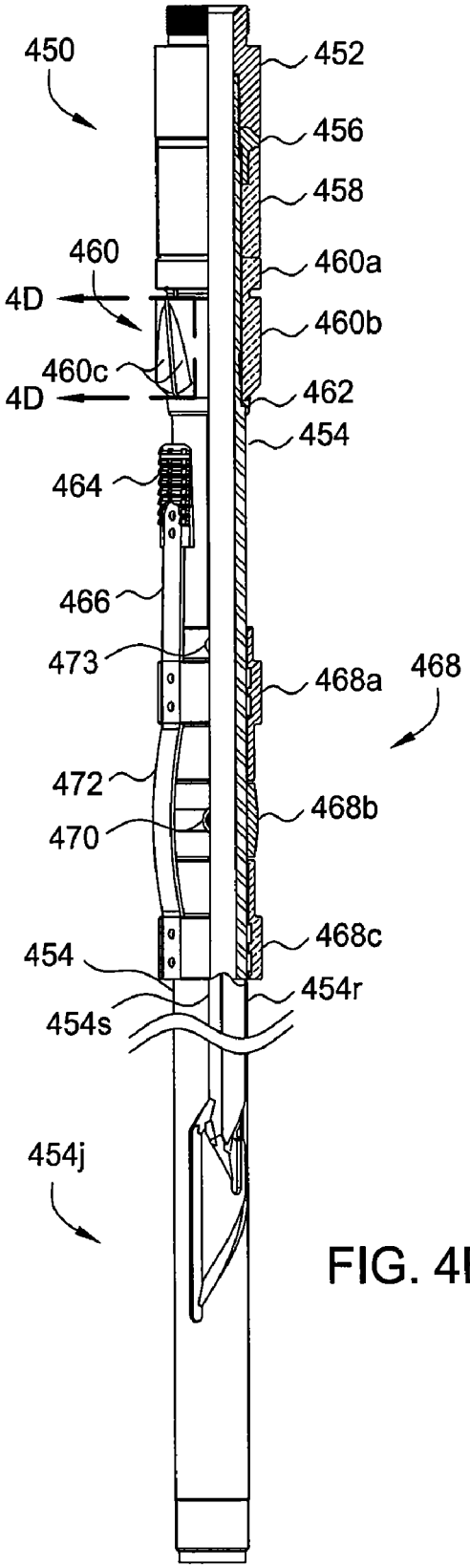
FIG. 4B is a partial half-sectional view of an anchor of the PC pump system of FIG. 4A.

FIG. 4B is a partial half-sectional view of the anchor subassembly 450 of the PC pump assembly 400. The anchor includes the cap 452, a J-mandrel 454, a sealing element 458, a slip mandrel 460, and a J-runner/slip retainer 468. The J-runner 468 includes two or more slips 464, two or more cantilever springs 466, upper 468*a* and lower 468*c* spring retainers, a J-pin retainer 468*b*, two or more bow springs 472, and a J-pin 470.

The cap 452, the gage ring 456, the sealing element 458, the slip mandrel 460, and the J-mandrel 454 are tubular members each having a central longitudinal bore therethrough. The cap 452 is connected to the J-mandrel 454 with a threaded connection. A longitudinal end of the cap 452 forms a tapered shoulder which abuts a tapered shoulder formed at a first longitudinal end of a gage ring 456. The gage ring 456 has a threaded inner surface which engages a threaded portion of an outer surface of the J-mandrel 454. The gage ring 456 may be made from metal or a hard plastic, such as PEEK. The gage ring 456 also has a curved shoulder formed at a second longitudinal end which abuts a curved shoulder formed at a first longitudinal end of the sealing element 458. Preferably, a portion of an inner surface of the sealing element 458 is bonded to an outer surface of the gage ring 456. The remaining portion of the inner surface of the sealing element 458 is disposed along the outer surface of the J-mandrel 454. The sealing element 458 is made from a polymer, preferably an elastomer. Alternatively, the sealing element 458 may be made from a urethane (urethane may or may not be considered an elastomer depending on the degree of cross-linking). During setting of the slips 464, the sealing element 458 is longitudinally compressed between the gage ring 456 and the slip mandrel 460 in order to radially expand into sealing engagement with the production tubing 500 (see FIG. 5). The sealing element 458 has a shoulder formed at a second longitudinal end which abuts a shoulder formed at a first longitudinal end of the slip mandrel 460.

Figure 4D:
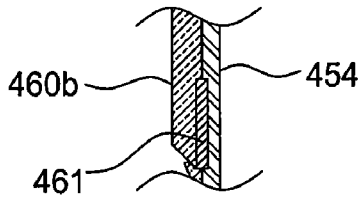
FIG. 4D is a sectional view taken along lines 4D-4D of FIG. 4B.

The slip mandrel 460 may include a base portion 460*a* and a plurality of finger portions 460*b* longitudinally extending from the base portion. A flat actuations surface 460*c* is formed in a portion of an outer surface of each of the finger portions 460*b*. Two adjacent flat surfaces cooperatively engage to form an actuation surface 460*c* for each of the slips 464. The discontinuity between the flat surfaces 460*c* and the remaining tubular outer surfaces of the finger portions 460*b*, when engaged with corresponding inner surfaces of the slips 464, provides rotational coupling between the slips 464 and the slip mandrel 460. Referring to FIG. 4D, rotational coupling between the slip mandrel 460 and the J-mandrel 454 is provided by a key 461 disposed in a slot formed in the outer surface of the J-mandrel 454 and a corresponding slot formed in an inner surface of the slip mandrel 460. Returning to FIG. 4B, the outer surface of the finger portions 460*b* is inclined at a second longitudinal end of the slip mandrel 460. The second longitudinal end of the slip mandrel 460 abuts a slip mandrel retainer 462. The slip mandrel retainer 462 abuts a shoulder formed in the outer surface of the J-mandrel 454. Attached to a second longitudinal end of the J-mandrel 454 by a threaded connection is an optional thread adapter 474. The thread adapter allows other tools (not shown) to be attached to the J-mandrel 454 if desired.

Figure 4C:
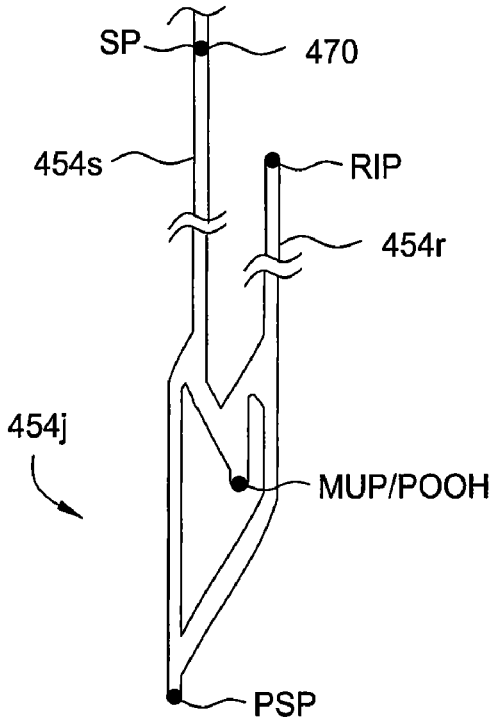
FIG. 4C is a schematic showing various operational positions of a J-pin and slotted path of the PC pump system of FIG. 4A.

Referring also to FIG. 4C, the J-runner 468 is disposed along the outer surface of the J-mandrel 454. The J-runner 468 includes the J-pin 470 which extends into a slotted path 454*j,r,s* formed in the outer surface of the J-mandrel 454. Alternatively, the slotted path 454*j,r,s* may be formed in an inner surface of the J-mandrel 454 or through the J-mandrel 454. The slotted path 454*j,r,s* may include three portions: a J-slot portion 454*j* formed proximate to a second longitudinal end of the J-mandrel 454, a first longitudinal or setting portion 454*s* extending from the J-slot 454*j* toward a first longitudinal end of the J-mandrel 454, and a second longitudinal or run-in portion 454*r* extending from the J-slot 454*j* toward the first longitudinal end of the J-mandrel 454. The slotted path 454*j,r,s* includes one or more ends or pockets at which the J-pin 470 is longitudinally coupled to the J-mandrel in one direction. Movement of the J-mandrel 454 in the opposite direction will move the J-pin to the next pocket (with the exception of the setting portion 454*s* which may not have a pocket). Inclined faces formed in the outer surface of the J-mandrel 454 bounding the slotted path 454*j,r,s* guide the J-pin 470 to a particular pocket in a particular sequence. Each of the pockets correspond to one or more operating positions of the anchor 450: a make-up position MUP, a run-in position RIP, a preset position PSP, a setting position SP, and a pull out of hole position POOH. Reference is made to movement of the J-mandrel 454 instead of movement of the J-runner 468 because, for the most part, the J-runner 468 will be held stationary by engagement of the bow springs 472 with the production tubing 500.

The J-pin 470 is disposed through an opening through a wall of the J-pin retainer 468*b* and attached thereto with a fastener. The spring retainers 468*a,c* and J-pin retainer 468*b* are tubular members each having a central longitudinal bore therethrough. The J-pin retainer 468*b* is disposed longitudinally between the spring retainers 468*a,c* with some clearance to allow for rotation of the J-pin retainer 468*b* relative to the spring retainers 468*a,c*. A retainer pin 473 is attached to the upper spring retainer 468*a* with a fastener and radially extends into the first longitudinal portion 454*s*, thereby rotationally coupling the upper spring retainer 468*a* to the J-mandrel 454 and maintaining rotational alignment of the slips 464 with the actuation surfaces 460*c*. Unlike the J-pin 470, the retainer pin 473 preferably remains in the first longitudinal setting portion 454*s* of the slotted path 454*j,r,s* during actuation of the anchor 450 through the various positions. Alternatively, the J-pin retainer 468*b* and the upper spring retainer 468*a* may be configured for the alternative where the slotted path 454*j,r,s* is formed on an inner surface of the J-mandrel 454 or therethrough. Attached to the upper 468*a* and lower 468*c* spring retainers with fasteners are two or more bow springs 472. As discussed above, the bow springs 472 are configured to compress radially inward when the anchor 450 is inserted into the production tubing 500, thereby frictionally engaging an inner surface of the production tubing 500 to support the weight of the J-runner 468. Alternatively, the bow springs 472 may be replaced by longitudinal spring-loaded drag blocks.

Also attached to the upper spring retainer 468*a* by fasteners are two or more cantilever springs 466. Attached to each of the cantilever springs 466 by fasteners is a slip 464. The cantilever springs 466 longitudinally couple the slips 464 to the J-runner 468 while allowing limited radial movement of the slips so that the slips may be set. Alternatively, the slips 464 may be pivotally coupled to the upper spring retainer 468*a* instead of using the cantilever springs 466. The slips 464 are tubular segments having circumferentially flat inner surfaces and arcuate outer surfaces. As discussed above, the flat inner surfaces of the slips 464 engage with the actuation surfaces 460*c* of the slip mandrel 460 to form a rotational coupling. Alternatively, the rotational coupling between the inner surfaces of the slips 464 and the actuation surfaces 460*c* of the slip mandrel 460 may be provided by straight splines, convex-concave surfaces, or key-keyways. Disposed on the outer surfaces of the slips 464 are teeth or wickers made from a hard material, such as tungsten carbide. When set, the teeth penetrate an inner surface of the production tubing 500 to longitudinally and rotationally couple the slips 464 to the production tubing 500. The teeth may be disposed on the slips 464 as inserts by welding or by weld deposition. Each slip 464 is longitudinally inclined so that when the slip is slid along the actuation surface 460*c* of the slip mandrel 460, the teeth of the slip 464 will be wedged into the inner surface of the production tubing 500.

Figure 5A:
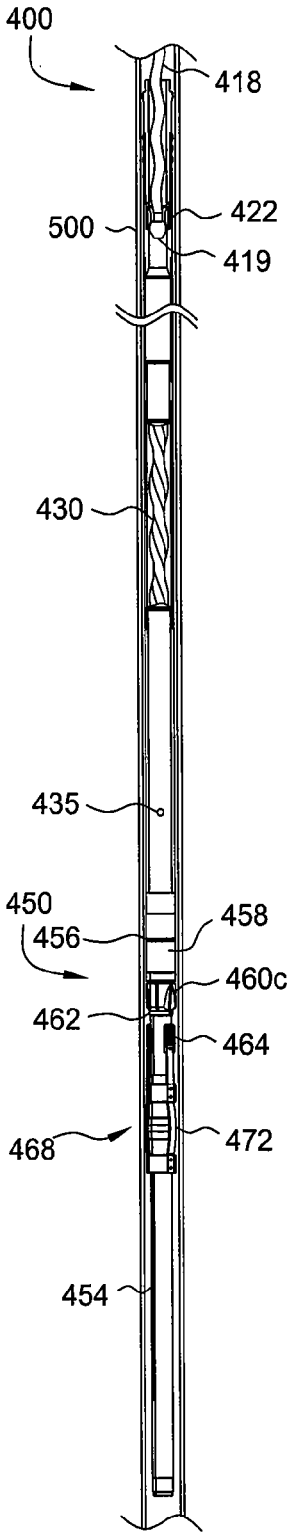
FIGS. 5A-G illustrate various positions of the PC pump system of FIG. 4A.

FIG. 5A illustrates the PC pump assembly 400 being run-into a wellbore. Referring also to FIG. 4C, at the surface, when the PC pump assembly 400 is being assembled or made-up, the J-pin 470 is in the make-up position MUP. The PC pump assembly 400 is then inserted into the production tubing 500. Alternatively, the anchor 450 may be configured to secure the PC pump assembly 400 to casing of a wellbore that does not have production tubing installed therein, or any other tubular located in a wellbore. The bow springs 472 engage the inner surface of the production tubing 500 and longitudinally and rotationally restrain the J-runner 468 (only longitudinally restrain the J-pin retainer 468*b*). The arrowhead 419 is engaged with the floating ring 422, thereby supporting the weight of the stator subassembly. The drive string is then lowered into the wellbore. The J-mandrel 454 moves down while the J-runner 468 is stationary. The J-pin 470 contacts the inclined boundary of the J-slot 454*j* at which point the J-pin retainer 468*b* will rotate until the J-pin 470 is longitudinally aligned with the run-in portion 454*r* of the slotted path 454*j,r,s*. The J-mandrel 454 continues to move down the wellbore. The run-in pocket RIP reaches the J-pin 470. The J-mandrel 454 then exerts a downward force on the J-runner 468 via the J-pin 470 which overcomes the frictional restraining force exerted by the bow springs 472. The J-runner 468 then begins to slide down the production tubing 500 with the stator subassembly and the rest of the anchor subassembly 450.

Figure 5B:
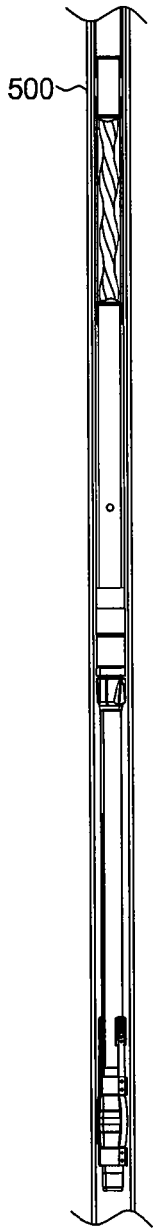

FIG. 5B illustrates the improved PC pump system in a preset position. Once the PC pump assembly 400 is lowered to the desired setting depth, the drive string is raised. The J-mandrel 454 moves upward while the J-runner 468 remains stationary. The J-pin 470 contacts another inclined boundary and rotates the J-pin retainer 468*b* until the preset pocket PSP engages the J-pin 470.

Figure 5C:
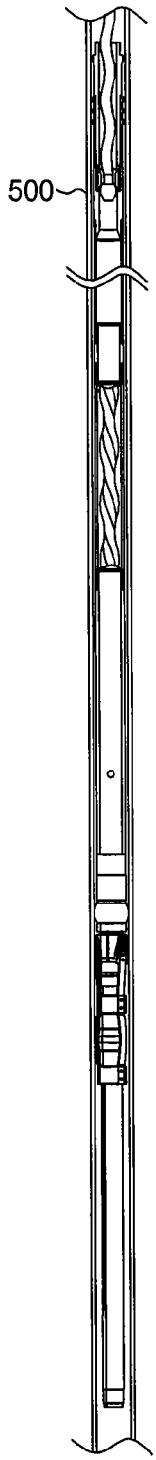

FIG. 5C illustrates the PC pump assembly 400 in a set position. The drive string is then lowered. The J-slot 454*j* travels downward and then the J-pin 470 contacts another inclined boundary and rotates the J-pin retainer 468*b* until the J-pin 470 is longitudinally aligned with the setting portion 454*s* of the slotted path 454*j,r,s*. The setting portion 454*s* moves downward until the slips 464 engage the actuation surfaces 460*c*. The slips 464 are moved radially outward into engagement with the production tubing 500 by engagement with the actuation surfaces 460*c*. The slip mandrel 460 is held stationary by engagement with the slips 464 and the J-mandrel 454 continues a downward movement. The gage ring 456 compresses the sealing element 458 against the stationary slip mandrel 460. The sealing element 458 radially expands into engagement with the production tubing 500. At this point, the anchor 450 is set, thereby longitudinally and rotationally coupling the stator subassembly to the production tubing 500.

Figure 5D:
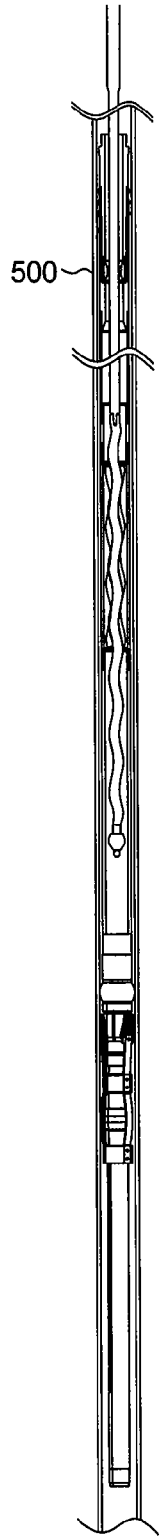

FIG. 5D illustrates the PC pump system in a pre-operational position. The drive string continues to be lowered. The arrowhead 419 unseats from the floating ring 422 and the rotor subassembly moves downward. The floating ring 422 floats as the rotor 418 moves through the floating ring 422. The rotor subassembly is lowered until the arrowhead 419 rests on the tag bar pin 435.

Figure 5E:
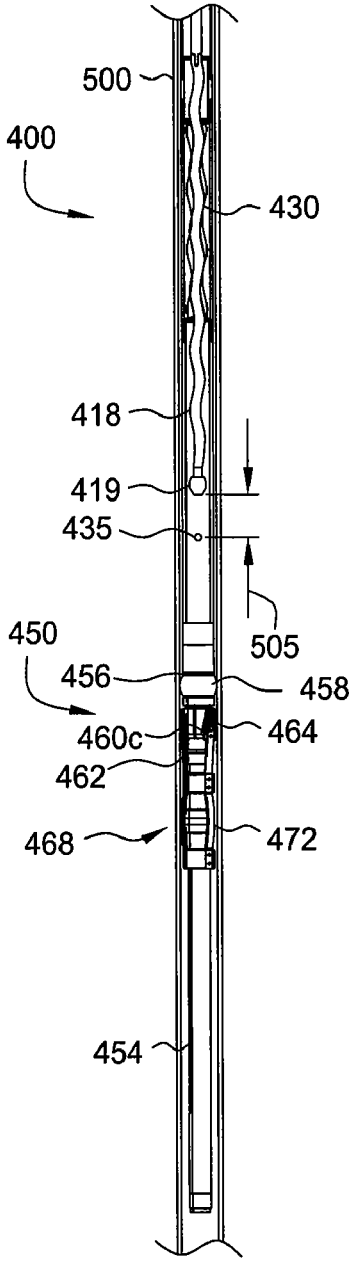

FIG. 5E illustrates the PC pump assembly 400 in an operational position. After compensating for rod stretch, the drive string is slowly lifted until the arrowhead 419 is at a predetermined distance 505, for example about 1 foot, above the tag bar pin 435. The PC pump assembly 400 is now in the operational position and pumping of production fluid from the wellbore to the surface may commence.

Figure 5F:
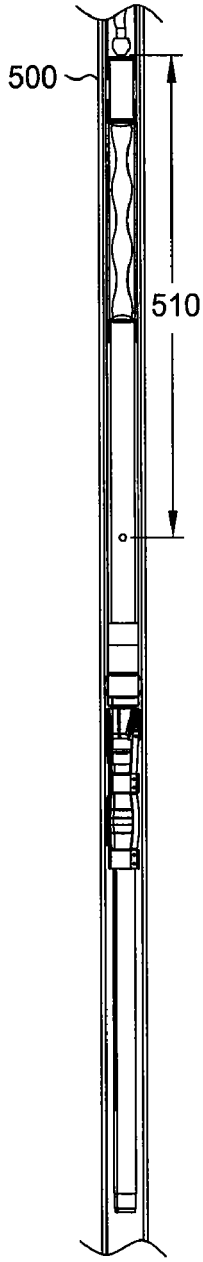

FIG. 5F illustrates the PC pump assembly 400 in a flushing position. The rotor 418 is lifted by a second predetermined distance 510, for example, the length of the rotor 418. Preferably, the second distance 510 should be sufficient so that the rotor 418 is lifted out of the stator 430 and less than that which would cause the arrowhead 419 to engage with the floating ring 422. The rotor 418 and the stator 430 may now be flushed of debris.

Figure 5G:
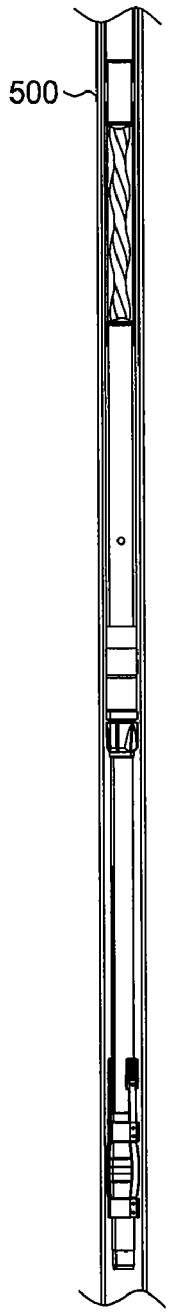

FIG. 5G illustrates the PC pump assembly 400 being removed from the wellbore. The drive string is lifted so that the arrowhead 419 engages with the floating ring 422. Lifting is continued. The gage ring 456 moves upward allowing the sealing element 458 to longitudinally expand and disengage from the production tubing 500. The slip mandrel retainer 462 engages the slip mandrel 460 and pushes the slip mandrel upward with the J-mandrel 454, thereby disengaging the actuating surfaces 460*c* from the slips 464. The cantilever springs 466 push the slips 464 radially inward to disengage the slips 464 from the production tubing 500. The setting portion 454*s* of the slotted path 454*j,r,s* moves upward relative to the stationary J-runner 468. The J-pin 470 then engages an inclined boundary and rotates the J-pin retainer 468*b* until the J-pin 470 is aligned and seats in the pull out of hole pocket POOH. The J-mandrel 454 exerts an upward force on the J-runner 468 which overcomes the frictional force of the bow springs 472. The J-runner 468 then slides up the production tubing 500 with the stator subassembly. The PC pump assembly 400 may be raised to the surface where it may be serviced and/or replaced. Alternatively, and as discussed above, the PC pump assembly 400 may be raised or lowered to a second location along the production tubing 500, re-installed, and further operated.

Figure 6:
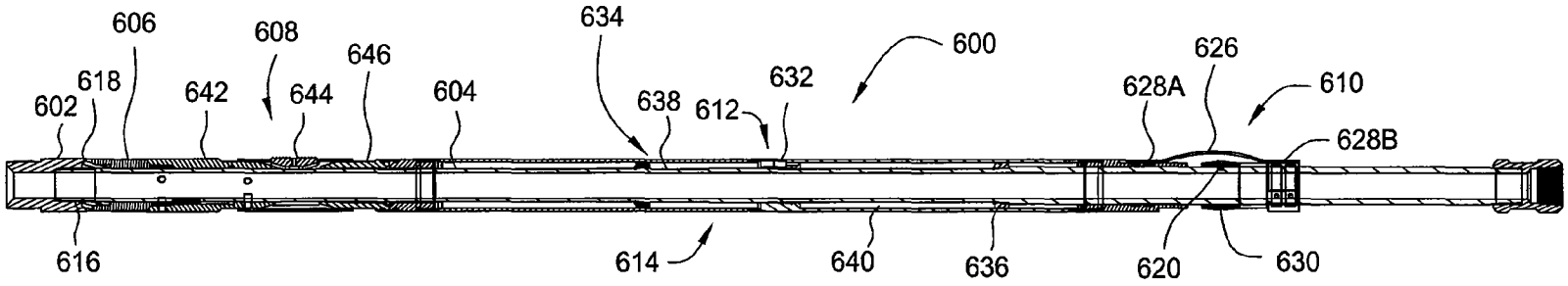
FIG. 6 is a cross sectional view of an anchor assembly according to one embodiment described herein.

FIG. 6 shows an anchor assembly 600 for anchoring downhole tools to a tubular, in the wellbore according to an alternative embodiment. The anchor assembly 600 comprises a cap 602, an inner mandrel 604, a sealing element 606, an anchor 608, an engagement member 610, an actuation assembly 612, and an outer mandrel 614. The actuation assembly 612 is adapted to selectively set and release the anchor 608 thereby engaging and disengaging the anchor assembly 600 with the tubular in a wellbore, as will be described in more detail below. The anchor assembly 600 may be coupled to any downhole tool including, but not limited to, any of the pumps described herein, packers, acidizing tools, whipstocks, whipstock packers, production packers and bridge plugs. Further, the anchor assembly 600 may be run into a tubular on any conveyance (not shown) including, but not limited to, a wire line, a slick line, a coiled tubing, a corod, a jointed tubular, or any conveyance described herein.

The anchor assembly 600 may include the cap 602 configured to couple the anchor assembly 600 to a downhole tool and/or a conveyance, not shown. The cap 602, as shown, includes a threaded male end adapted to couple to a female end of the downhole tool and/or conveyance. It should be appreciated that any connection may be used so long as the cap 602 is capable of coupling to the downhole tool and/or conveyance. The cap 602 is coupled to the inner mandrel 604 with a threaded connection thereby preventing relative movement between the cap 602 and the inner mandrel 604 during operation of the anchor 608. The cap 602 may have a lower shoulder 616 adapted to engage a gage ring 618 during the actuation of the anchor assembly, as will be discussed in more detail below.

Figure 7A:
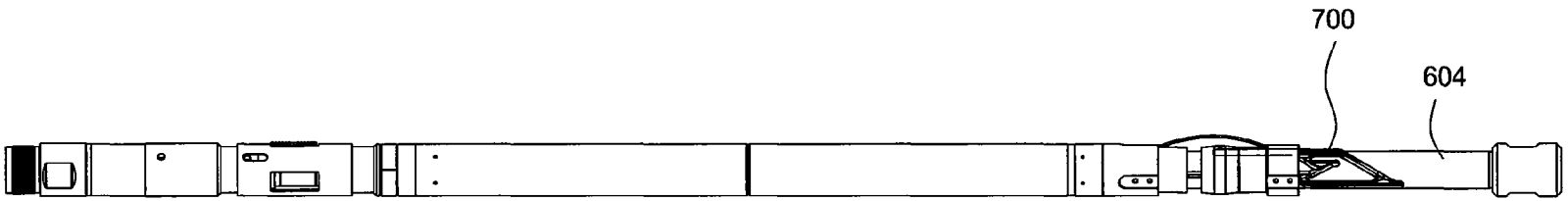
FIG. 7A is a side view of an anchor assembly according to one embodiment described herein.
Figure 7B:
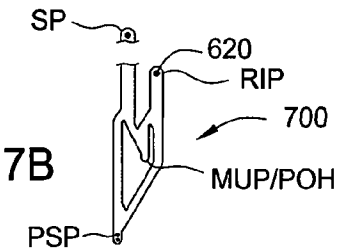
FIG. 7B is a detail of a slotted path according to one embodiment described herein.

The inner mandrel 604 is configured to move relative to the engagement member 610, and the outer mandrel 614 in order to set and release the anchor 608, as will be described in more detail below. As shown in FIGS. 7A and 7B, the inner mandrel 604 includes a slotted path 700. The slotted path 700 may be adapted to engage and manipulate a J-pin 620 in order to set and release the anchor 608. The inner mandrel 604 supports the sealing element 606, the anchor 608, the engagement member 610, and the actuation assembly 612. The inner mandrel 604 is manipulated by the conveyance, not shown, in order to operate the anchor 608 and the sealing element 606.

The engagement member 610 may be any member adapted to engage the inner wall of a tubular, not shown, that the anchor assembly 600 is operating in. The engagement member 610, as shown, is two or more bow springs 626. The bow springs 626 are configured to compress radially inward when the anchor assembly 600 is inserted into the tubular, thereby frictionally engaging an inner surface of the tubular. The engagement member 610 is adapted to engage the inner wall of the tubular with enough force to prevent the engagement member from moving relative to the inner mandrel 604 during setting and unsetting operations of the anchor assembly 600. The engagement member 610, however, does not provide enough force to prevent the anchor assembly 600 from moving in the tubular during run, run out, and relocation in the tubular. The two or more bow springs 626 may be coupled on each end by an upper 628*a* and a lower 628*b* spring retainer. Further, the two or more bow springs 626 couple to the J-pin 620, via the J-pin retainer 630. The upper spring retainer 628*a* engages a lower end of the actuation assembly 612. This enables the engagement member 610 to manipulate the actuation assembly 612. The actuation assembly in turn operates the anchor assembly 600 as the inner mandrel 604 manipulates the J-pin 620 in the slotted path 700.

FIG. 7B shows the slotted path 700 with the J-pin 620 in the run in position. The operation of the J-pin 620 in the slotted path may be the same as described above. As the anchoring assembly 600 is being run in, or moved in the tubular, the J-pin 620 is in the run in position. The J-pin 620 remains in the run-in position as a downward force, such as gravity or force from the conveyance, is applied to the inner mandrel 604 in order to move the anchoring assembly 600 down the tubular. In the run in position the J-pin 620 is against an upper end of the slotted path 700 thereby preventing relative movement between the inner mandrel 604 and the engagement member 610. Once the anchoring assembly 600 arrives at a desired setting position, the inner mandrel 604 is lifted up from the surface of the wellbore. As the inner mandrel 604 moves up, the engagement member 610 holds the J-pin 620 stationary due to the friction force between the two or more bow springs 626 and the tubular. The continued upward movement of the inner mandrel 604 and the slotted path 700 move the J-pin 620 into the preset position PSP. With the J-pin 620 in the preset position PSP, further upward pulling on the inner mandrel 604 causes the entire anchoring assembly 600, including the engagement member 610, to move up due to the J-pin being engaged with the lower end of the slotted path 700. Thus, the upward movement of the inner mandrel 604 is typically stopped once the J-pin is in the preset position PSP.

The inner mandrel 604 may then be released or forced down from the surface. As the inner mandrel 604 moves down the engagement member 610 maintains the J-pin 620 stationary in the same manner as described above. As the inner mandrel 604 moves down relative to the J-pin 620, the J-pin moves to the set position SP. The movement of the J-pin 620 between the preset position PSP and the set position SP causes the anchor assembly to set as will be described in more detail below. The J-pin will remain in the set position SP until it is desired to relocate the anchor assembly 600. To release the anchor assembly 600, the inner mandrel 604 is pulled up from the surface until a predetermined force is reached in the actuation assembly 612. Once the predetermined force is reached, further pulling on the mandrel causes the J-pin 620 to move from the set position to the pull out of hole POOH position. In the pull out of hole POOH position, the J-pin 620 prevents relative movement between the engagement member 610 and the inner mandrel 604 with continued upward pulling on the inner mandrel 604. If desired, the inner mandrel 604 may be released and the J-pin 620 is allowed to move back to the run in position RIP in order to move the anchoring assembly down and/or reset the anchoring assembly in the tubular without the need to remove the anchoring assembly from the tubular. In one embodiment, the predetermined force is greater than 5000 pounds of tensile force in the inner mandrel 604. Although the predetermined force is described as being greater than 5000 pounds, it should be appreciated that the predetermined force may be set to any number, and may be as low as 100 lbs and as high as 50,000 lbs.

The sealing element 606 and the anchor 608 are set in a similar manner as described above. As the inner mandrel 604 moves down, the engagement member 610 maintains the outer mandrel 614 in a stationary position. The inner mandrel 604 moves the cap 602 against the gage ring 618 which in turn puts a force on the sealing element 606 and a floating slip block 642. As the floating slip block 642 moves down, it engages one or more slips 644 and forces the one or more slips 644 radially outward. The one or more slips 644 continue to move outward between the floating slip block 648 and a stationary slip block 646. The stationary slip block 646 may be coupled to the outer mandrel 614 and in turn the engagement member 610 thereby ensuring that the stationary slip block 646 remains stationary relative to the inner mandrel 604 and the floating slip block 642 as the J-pin 620 travels between the preset position PSP and the set position SP. When the J-pin 620 reaches the set position SP, the slips 644 are immovably fixed to the inner wall of the tubular as described above. Further, the sealing element 606 is engaged against the tubular thereby preventing flow past an annulus between the anchoring assembly 600 and the tubular.

The actuation assembly 612 may include two or more valves 632, a first piston 634, a second piston 636, and a fluid located in a first piston chamber 638 and a second piston chamber 640. The first piston 634 and the second piston 636 are fixed to the inner mandrel 604. Further, the first piston 634 and the second piston 636 have a fluid seal, for example an o-ring, which seals the annulus between the inner mandrel 604 and the outer mandrel 614.

The first piston chamber 638, as shown in FIG. 6, is defined by the space between the inner mandrel 604, the outer mandrel 614, the first piston and the two or more valves 632. The second piston chamber 640, as shown in FIG. 6, is defined by the space between the inner mandrel 604, the outer mandrel 614, the second piston 636 and the two or more valves 632. The two or more valves 632 control the flow of the fluid between the first piston chamber 638 and the second piston chamber 640 as the inner mandrel 604 is manipulated relative to the J-pin as will be described in more detail below.

Figure 8:
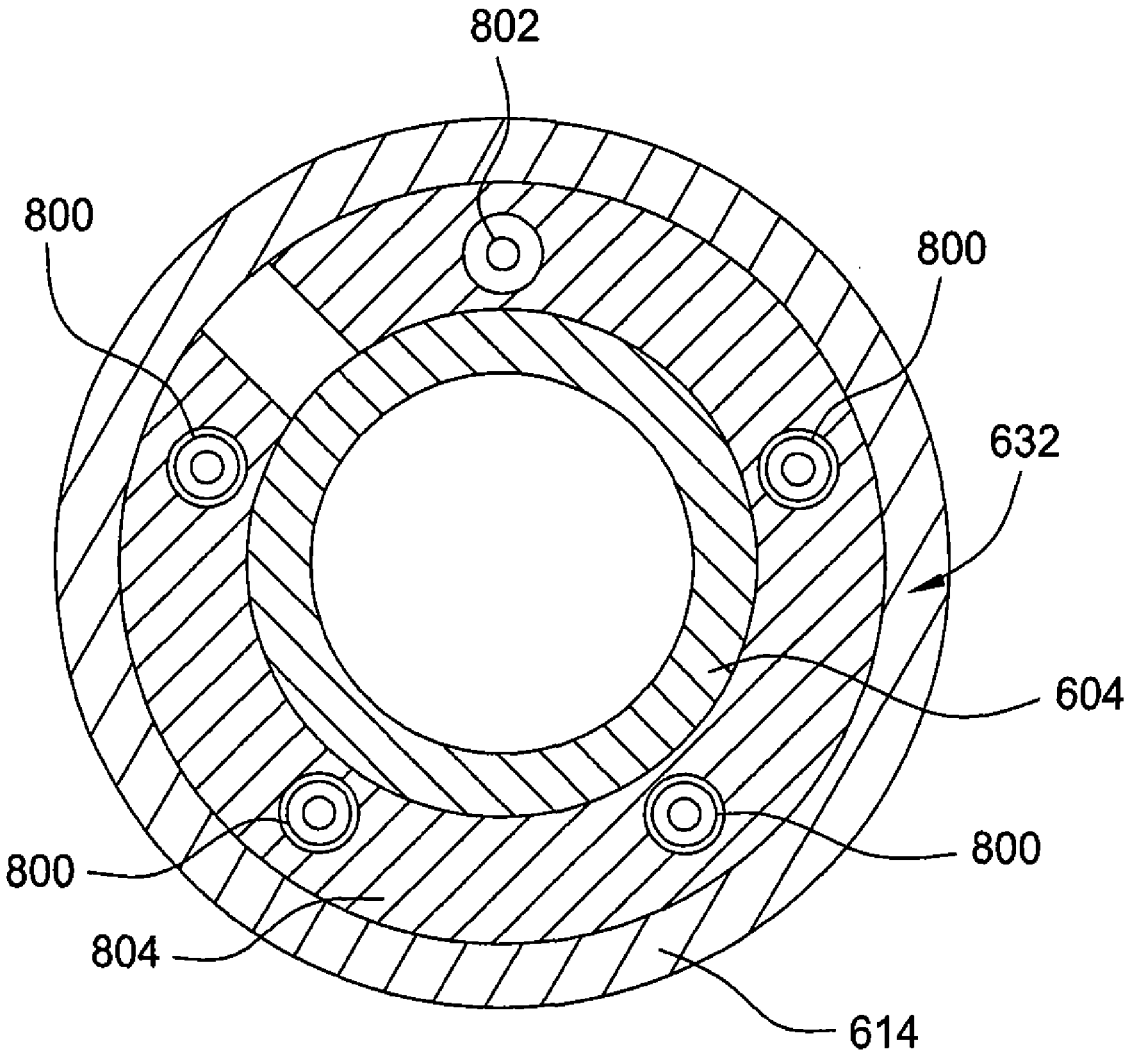
FIG. 8 is a cross sectional view of a valve assembly according to one embodiment described herein.

FIG. 8 shows a cross sectional view of the two or more valves 632. The two or more valves 632 include one or more one way valves 800 and at least one relief valve 802, located in an annular body 804. The annular body 804 may be located between the inner mandrel 604 and the outer mandrel 614. In one embodiment, the annular body 804 is fixed to the outer mandrel 614, while the inner mandrel 604 is allowed to move relative to the annular body 804. It should be appreciated that in another embodiment the annular body 804 may be fixed to the inner mandrel 604, while the outer mandrel 614 is allowed to move relative to the annular body 804. Further, it should be appreciated that the general location and arrangement of the piston chambers, the valves, actuation assembly and the anchor may be moved so long as the actuation assembly can set and release the anchor.

The one or more one way valves 800 allow fluid from the first piston chamber 638 to flow into the second piston chamber 640 as the inner mandrel 604 moves down relative to the outer mandrel 614. Once the fluid flows into the second piston chamber, the one or more one way valves prevent fluid flow back into the first piston chamber 638. Thus, as the inner mandrel moves down from the preset position PSP to the set position SP, the one or more one way valves 800 allow the inner mandrel 604 to move down while preventing the inner mandrel 604 from moving up relative to the outer mandrel 614. This ensures that the sealing element 606 and the anchor 608 are set and not released as the inner mandrel is moved down.

Figure 9A:
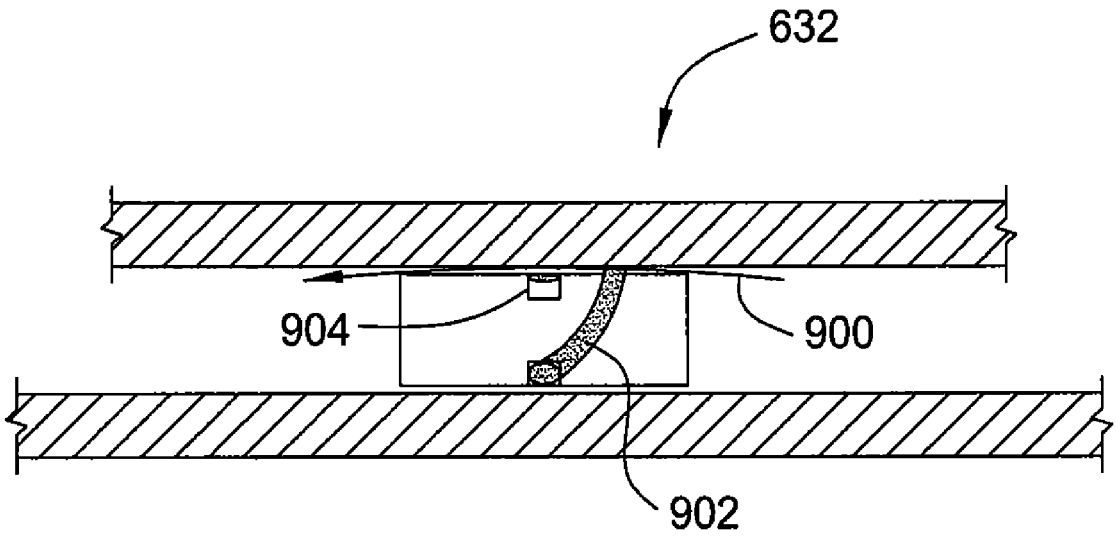
FIGS. 9A and 9B are cross sectional views of a sealing member for the valve assembly according to one embodiment described herein.
Figure 9B:
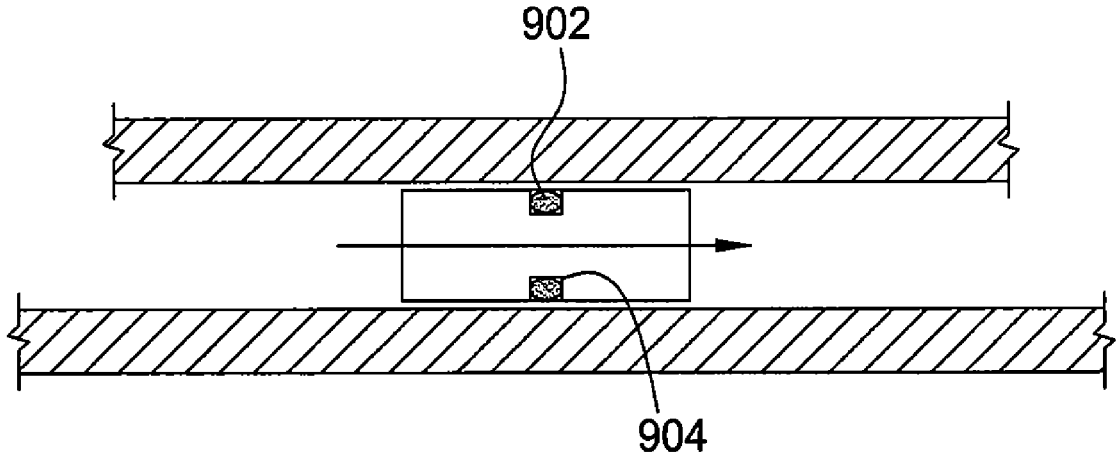

FIG. 6 shows the inner mandrel 604 and the J-pin 620 in the run in position RIP. In order to move the inner mandrel 604 and thereby the J-pin 620 to the preset position PSP, the inner mandrel 604, the first piston 634, and the second piston 636 must move up relative to the J-pin 620 and the outer mandrel 614. The upward movement of the inner mandrel 604 causes the second piston chamber 640 to lose volume and the first piston chamber 638 to gain volume. However, one or more one way valves 800 and at least one relief valve 802 will not allow fluid to flow through the one or more valves 632 without increasing the pressure to the predetermined pressure to activate the relief valve 802. Therefore, a fluid path 900, shown in FIG. 9A, provides a bypass of the two or more valves 632. The fluid path 900 is open when the J-pin 620 is in the run in position RIP. Therefore, as the J-pin 620 moves down relative to the inner mandrel 604 from the run in position RIP to the preset position PSP, fluid freely bypasses the two or more valves 612. This allows the volume in the first piston chamber 638 to increase as the J-pin 620 moves to the preset position. The movement of the inner mandrel 604 and the J-pin 620 to the preset position closes the fluid path 900. Thus, when the inner mandrel 604 begins to move from the preset position PSP to the set position SP, the fluid may only move between the first piston chamber 638 and the second piston chamber 640 through the two or more valves 632.

In one embodiment, the fluid path 900 is opened and closed by a moveable seal 902 moving from an unsealed to a sealed position. The moveable seal 902 is not seated in a groove 904 when the J-pin is in the run in position RIP. When the inner mandrel 604 begins to move down toward the preset position PSP, the inner mandrel 604 pushes the moveable seal 902 into the groove 904 thereby sealing the two or more valves 632 between the inner mandrel 604 and the outer mandrel 614. The moveable seal 902 remains in this position until the anchor is ready to be removed from the tubular. The movement of the J-pin 620 between the pull out of hole position POOH and the run in position RIP moves the moveable seal 902 from the sealed position to the unsealed position thereby opening the fluid path 900.

In an alternative embodiment, the seal is not moved and a fluid resistor (not shown) is used in addition to or as an alternative to the relief valve 802. The fluid resistor allows fluid to flow slowly past the two or more valves 632 if a continuous force and fluid pressure is applied to it. The fluid resistor will not allow fluid past it in the event of quick impact loads. Therefore, as the inner mandrel 604 moves from the run in position RIP to the preset position PSP, the fluid resistor slowly allows the fluid to move from the second piston chamber 640 to the first piston chamber 638. Once the J-pin is in the preset position PSP, the one way valves 800 allow the inner mandrel 604 to operate in the manner described above.

To release the anchor 608, the inner mandrel must be moved from the set position SP to the pull out of hole position POOH. A tensile or upward force is applied to the conveyance thereby causing the inner mandrel 604 to attempt to move up relative to the J-pin 620, the two or more valves 632, and the outer mandrel 614. This upward force puts the fluid in the second piston chamber 640 into compression. The one way valves 800 prevent the fluid from flowing past the two or more valves 632. The increased pulling on the inner mandrel 604 increases the pressure in the second piston chamber 640 until the predetermined pressure of the relief valve 802 is reached. The predetermined pressure causes the relief valve 802 to go off thereby allowing the fluid in the second chamber 640 to freely flow into the first chamber 638. This allows the inner mandrel 604 to move up thereby releasing the anchor 608 and the sealing element 606. When the J-pin 620 has reached the pull out of hole position POOH, the anchor 608 is no longer engaged with the tubular. The relief valve 802 may automatically reset once the fluid pressure in the second piston chamber 640 is relieved.

Thus, in the alternative embodiment the anchor assembly 600 is run into the hole with the J-pin 620 in the run in position RIP. The engagement member 610 engages the inner wall of the tubular. The anchor assembly 600 travels in the tubular until a desired location is reached. The inner mandrel 604 is then lift up and the engagement member 610 maintains the J-pin 620, the outer mandrel 614, the two or more valves 632, and the stationary slip block 646 in a stationary position. The upward movement of the inner mandrel 604 causes the second fluid chamber 640 to lose volume thereby pushing fluid past the fluid path 900 into the first fluid chamber. The continued movement of the inner mandrel 604 moves the J-pin 620 from the run in position RIP to the preset position PSP. As the inner mandrel 604 moves from the run in position RIP to the preset position PSP the moveable seal 902 is set thereby sealing the two or more valves 632 between the outer mandrel 614 and the inner mandrel 604. The sealing element 606 and the anchor 608 may then be set by removing the upward force from the inner mandrel 604 and allowing the inner mandrel to move down thereby moving the J-pin 620 to the set position SP. The downward movement of the inner mandrel 604 causes the cap 602 to engage the gage ring 618. The gage ring 618 applies force to the sealing element 606 and the floating slip blocks 642. The floating slip block 642 wedges the slips 644 against the stationary slip blocks 646 thereby moving the slips 644 radially outward and into engagement with the inner wall of the tubular. The compression of the sealing element 606 causes the sealing element to sealing engage the inner wall of the tubular. As the inner mandrel 604 moves from the preset position PSP to the set position SP, the fluid path 900 is closed. With the anchor assembly 600 set in the tubular, a downhole operation may be performed. In one example a progressive cavity pump, as described above, is used to pump production fluid from the tubular.

The downhole operation is performed until it is desired to move or remove the anchor assembly 600 from the tubular. To disengage the anchor assembly 600, the inner mandrel 604 is pulled up. This causes the pressure in the second piston chamber 640 to increase due to the one way valves 800 not allowing flow past the two or more valves 632. The pressure is increased in the second piston chamber 640 until the relief valve 802 is set off. The fluid is then free to flow to the first piston chamber 638 thereby allowing the inner mandrel 604 to move up relative to the slips 644 and the outer mandrel 614. The upward movement of the inner mandrel 604 causes the slips 644 and the sealing element 606 to disengage the tubular. The inner mandrel 604 now has the J-pin in the pull out of hole position. If desired, continued pulling on the conveyance will remove the anchor assembly 600 from the wellbore. If it is desired to relocate and/or reset the tool downhole, the inner mandrel 604 is allowed to move down relative to the engagement member 610. This allows the inner mandrel 604 and the J-pin 620 to move back to the run in position RIP. As the inner mandrel 604 moves toward the run in position RIP, the fluid path 900 is reopened. The anchor assembly is now free to move to a second location in the tubular and perform another downhole operation.

While the foregoing is directed to embodiments of the present invention, other and further embodiments of the invention may be devised without departing from the basic scope thereof, and the scope thereof is determined by the claims that follow.

The invention claimed is:

1. An anchoring assembly for anchoring a downhole tool in a wellbore, comprising:

an inner mandrel;

an anchor actuatable by the manipulation of the inner mandrel;

an engagement member configured to engage an inner wall of the wellbore and resist longitudinal forces applied to the anchoring assembly; and an actuation assembly comprising:

one or more one way valves configured to allow fluid to flow from a first piston chamber to a second piston chamber; and a relief valve configured to release fluid pressure in the second piston chamber, wherein the relief valve allows the release of the anchor when a predetermined fluid pressure is applied to the second piston chamber.

2. The assembly of claim 1, further comprising a fluid path configured to allow the fluid to bypass the one or more one way valves and the relief valve when the inner mandrel moves to a preset position.

3. The assembly of claim 2, further comprising a fluid seal configured to seal the fluid path when the anchor is set.

4. The assembly of claim 3, wherein the fluid seal is a moveable o-ring.

5. The assembly of claim 1, wherein the actuation assembly further comprises a slotted path and a J-pin.

6. The assembly of claim 1, wherein the downhole tool is a PCP pump.

7. The assembly of claim 1, wherein the predetermined fluid pressure is achieved by applying a tensile force to the inner mandrel.

8. An actuation assembly for actuating an anchor downhole, comprising:

a first piston chamber;

a second piston chamber; and a valve assembly separating the first piston chamber and the second piston chamber, the valve assembly further comprising:

one or more one way valves;

at least one relief valve;

a fluid path configured to bypass the valve assembly thereby allowing fluid to flow freely between the first piston chamber and the second piston chamber prior to an initial actuation of the actuation assembly; and a moveable seal configured to seal the fluid path during actuation.

9. The assembly of claim 8, wherein the relief valve is configured to maintain fluid pressure in the second piston chamber until a predetermined release pressure is applied in the second piston chamber.

10. The assembly of claim 8, further comprising an inner mandrel movable relative to an outer mandrel, wherein the first and second piston chambers are formed between the inner and outer mandrels.

11. The assembly of claim 10, further comprising a first piston coupled to the inner mandrel and disposed between the inner and outer mandrels, wherein movement of the inner mandrel in a first direction moves the first piston to force fluid from the first piston chamber to the second piston chamber through the one or more one way valves.

12. The assembly of claim 11, further comprising a second piston coupled to the inner mandrel and disposed between the inner and outer mandrels, wherein movement of the inner mandrel in a second direction moves the second piston to force fluid from the second piston chamber to the first piston chamber through the relief valve.

13. The assembly of claim 12, wherein the relief valve is configured to maintain fluid pressure in the second piston chamber until a predetermined fluid pressure is formed in the second piston chamber by movement of the inner mandrel and the first piston.

14. The assembly of claim 13, wherein the moveable seal is configured to seal the fluid path during movement of the inner mandrel in the second direction.

15. An assembly for anchoring a downhole tool in a wellbore, comprising:

a first mandrel movable relative to a second mandrel;

a first piston chamber and a second piston chamber formed between the first and second mandrels;

a first piston and a second piston each coupled to the first mandrel;

a one way valve configured to allow fluid flow from the first piston chamber to the second piston chamber by movement of the inner mandrel and the first piston relative to the one way valve; and a relief valve configured to release fluid flow from the second piston chamber to the first piston chamber when a predetermined fluid pressure is formed in the second piston chamber by movement of the inner mandrel and the second piston relative to the relief valve.

16. The assembly of claim 15, further comprising one or more engagement members operable to secure the second mandrel against movement of the first mandrel.

17. The assembly of claim 15, further comprising a fluid path configured to allow the fluid to temporarily bypass the one way valve and the relief valve when the inner mandrel moves to a pre-set position.

18. The assembly of claim 17, further comprising a seal configured to seal the fluid path when the inner mandrel moves to a set position.

19. The assembly of claim 15, wherein the relief valve is configured to maintain fluid pressure in the second piston chamber until the predetermined fluid pressure is formed in the second piston chamber by movement of the inner mandrel and the first piston.

20. The assembly of claim 15, further comprising an anchor, wherein movement of the inner mandrel in a first direction sets the anchor in the wellbore, and wherein movement of the inner mandrel in a second direction releases the anchor from the wellbore upon release of fluid flow through the relief valve.

* * * * *